US005460211A

United States Patent [19]

Minati

[11] Patent Number: 5,460,211

[45] Date of Patent: Oct. 24, 1995

[54] COMPONENT HYDRAULIX LOG SPLITTER

[76] Inventor: Frank E. Minati, 521 E. Prospect St., Kewanee, Ill. 61443

[21] Appl. No.: 201,107

[22] Filed: Feb. 23, 1994

[51] Int. Cl.[6] ..... B27L 7/00

[52] U.S. Cl. ..... 144/193 A; 144/366

[58] Field of Search ..... 417/231, 234; 144/193 R, 193 A, 366

[56] References Cited

U.S. PATENT DOCUMENTS

| | | | |
|---|---|---|---|
| 3,779,295 | 12/1973 | Balsbaugh | 144/193 A |
| 4,378,038 | 3/1983 | Doiron et al. | 144/193 A |
| 4,378,826 | 4/1983 | Beach | 144/193 A |

*Primary Examiner*—W. Donald Bray
*Attorney, Agent, or Firm*—Niro, Scavone Haller & Niro

[57] ABSTRACT

A portable hydraulic log splitter assembly having separate power pack and log splitting modules is disclosed. The pump for the log splitter can be powered by either an electric or gas motor. The pump is operated in connection with a four position regenerative safety release valve that is biased toward neutral in the forward position so as to automatically disengage the cutting blade if the valve's handle is not manually held in an operational position by the user. The valve permits an increase in driving force applied to the cutting blade up to a predetermined limit to overcome log resistance. The valve has a further regenerative feature allowing for faster splitting strokes by the cutting blade. In order to reduce weight for portability purposes, the cutting blade (formed of tool steel) is mounted on a relatively lightweight aluminum base. Through holes in the cutting blade receive molten aluminum when the base is molded so as to be integrally mounted on and locked into the base. Weight of the splitting module is further reduced by use of tie rods to carry a log to be split.

24 Claims, 3 Drawing Sheets

FIG. 6
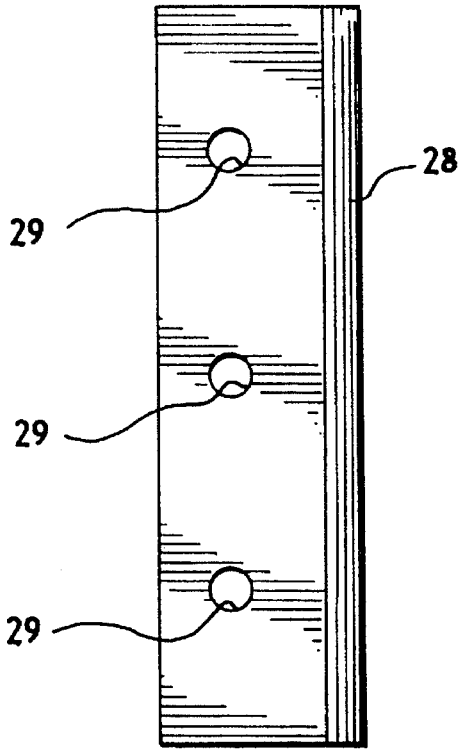
FIG. 7
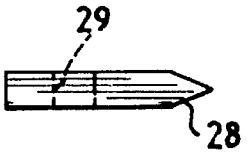
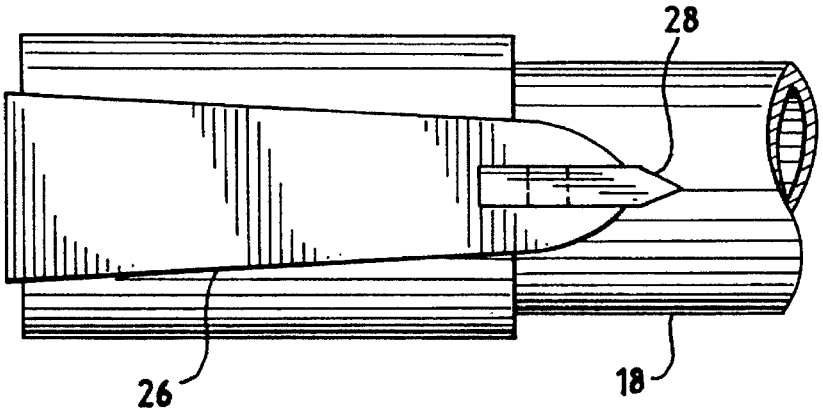
FIG. 8

COMPONENT HYDRAULIX LOG SPLITTER

BACKGROUND OF THE INVENTION

I. Field of the Invention

Portable hydraulic log splitters are increasingly being desired by experienced outdoorsmen, wood gatherers, and campers. Portable hydraulic log splitters greatly reduce the amount of time and effort needed to split wood or logs into manageable pieces for consumption.

Efforts to develop hydraulic log splitters generally available to the public have resulted in a variety of cumbersome integrated devices that, only in theory, are portable. Portable hydraulic log splitters that are currently available are wedded to one particular form of propulsion or another and include relatively heavy structural members. Also, these log splitters involve very complex machinery that is prone to breakdown. Finally, some log splitters are potentially dangerous tools that are often used on camping trips and other forays away from public assistance without the availability of an automatic safety or failsafe switch. Thus, there is a need for a portable hydraulic log splitter that operates in a simple fashion, can be broken down into components having manageable weights for ease of transportation and use, and that can be operated safely.

The invention relates to a portable hydraulic log splitter that can be broken down into components and is adaptable to operate with either an electric or gas motor. The embodiments disclosed are actuated through the operation of a single stage hydraulic pump and a four position regenerative safety release valve. The pump can be powered through the use of either a gas or an electric motor. The splitter further offers safety features through the use of a control valve that is biased towards automatic disengagement of driving force applied to the cutting blade. The disclosed invention also includes a selection of splitting speeds and further includes various novel arrangements to reduce the weight of the modular assembly.

II. Description of the Prior Art

U.S. Pat. No. 4,498,293 (Gregory) discloses a portable hydraulic log splitter where a pusher member carried on a cylinder pushes a log against a blade carried on a frame to which the cylinder is secured. Gregory discloses an electric motor to power the log splitter that is mounted to the log splitter frame. Gregory is directed towards a hydraulic actuator pump based upon a ball and cup system that blocks off certain passageways to build up pressure within the pump to overcome log resistance.

Gregory does not suggest the desirability of a separable power pack for a log splitter module, nor does he suggest the possibility of a pump that can be powered by either electric or gas motors. Likewise, Gregory does not disclose any safety features for the automatic disengagement of the splitting/retraction driving forces applied to the cutting blade. Also, Gregory discloses a structure for pushing a log toward a stationary blade, thus providing a more unwieldy means of splitting wood than the present invention. Further, Gregory does not disclose the feature of having a user selectable overdrive capability for increasing cutting speed.

U.S. Pat. No. 4,782,870 (Duerr '870) discloses a portable wood splitter having a splitter frame adjustably mounted to a support frame. Duerr '870 suggests the desirability of rotating a log splitter for splitting operation in either a vertical or horizontal position. Duerr further discloses a towing tongue and a hitch connector for connection to a car or some other similar form of motorized transport.

Duerr '870, however, does not disclose or suggest the desirability of a separate, modular power pack. Further, while Duerr '870 does disclose the use of a stripper, it offers no safety feature that guarantees the automatic disengagement of the cutting blade in combination with an optional higher splitting speed feature. Duerr '870 also does not disclose the flexibility of providing either electric or gas motor drive for a pump or a relatively lightweight log cutting support frame.

U.S. Pat. No. 4,770,218 (Duerr '218) discloses a portable log splitter with a block stripper and stroke stop. Duerr '218 discloses a collar-type attachment that can be selectively positioned along a frame to abut the cutting blade as it is withdrawn from its fully extended position. Duerr '218, however, is directed toward the efficiency in the cutting action of the machine, not the user safety features of the blade stroke. Further, Duerr '218 does not suggest a separable power pack unit for driving the log splitter.

In short, none of the prior art, alone or in combination suggest a modular hydraulic log splitter with an automatic safety disengage feature in combination with an optional high speed splitting mode. Further, none of the prior art discloses a portable hydraulic log splitter with a detachable power pack that can be powered by either a gas or electric motor, in combination with a control valve that is biased toward a "power off" or neutral condition. And no suggestion is made for a relatively lightweight support frame including a cutting blade of hardened tool steel compositely and integrally molded into an aluminum mounting and transport base.

SUMMARY OF THE INVENTION

My invention comprises a portable hydraulic log splitter that has a separate power pack and a relatively lightweight cutting blade/log support assembly. The pump for the log splitter can be driven by either an electric or gas motor. The pump is operated by a four position control valve that is biased toward a neutral position and to automatically disengage the cutting blade if the valve handle is not manually held in one of its extension modes by the user. The valve further provides for a selective increase in speed of the cutting blade to expedite low resistance splitting activity.

Accordingly, it is an object of the invention to provide a portable hydraulic log splitter that is modular and relatively lightweight.

A further object of my invention is to provide a modular hydraulic log splitter where the separate modules can be lifted and transported comfortably.

Yet another object of the invention is to provide a portable hydraulic log splitter that can be operated by either a gas or electric motor.

Still a further object of the invention is to provide a hydraulic log splitter will automatically disengage the cutting blade in case of accident.

Still a further object of the present invention is to provide a hydraulic log splitter having a second faster or "overdrive" cutting speed for relatively low resistance splitting activity.

Yet another object of my invention is to provide a composite cutting blade assembly formed of an aluminum base to reduce weight and a cutting edge formed of hardened tool steel which is integrally molded and locked into the base.

Still another object of the invention is to provide a relatively lightweight log support structure and cutting blade drive means through a unique arrangement of tie rods.

BRIEF DESCRIPTION OF THE DRAWINGS

FIG. 6 shows a side view of the cutting blade before being molded into its transport base.

FIG. 7 shows an top view of the cutting blade illustrated in FIG. 6.

FIG. 8 shows a top view of the cutting blade in its mounting base or collar.

DETAILED DESCRIPTION OF THE PREFERRED EMBODIMENT

Figure 1:
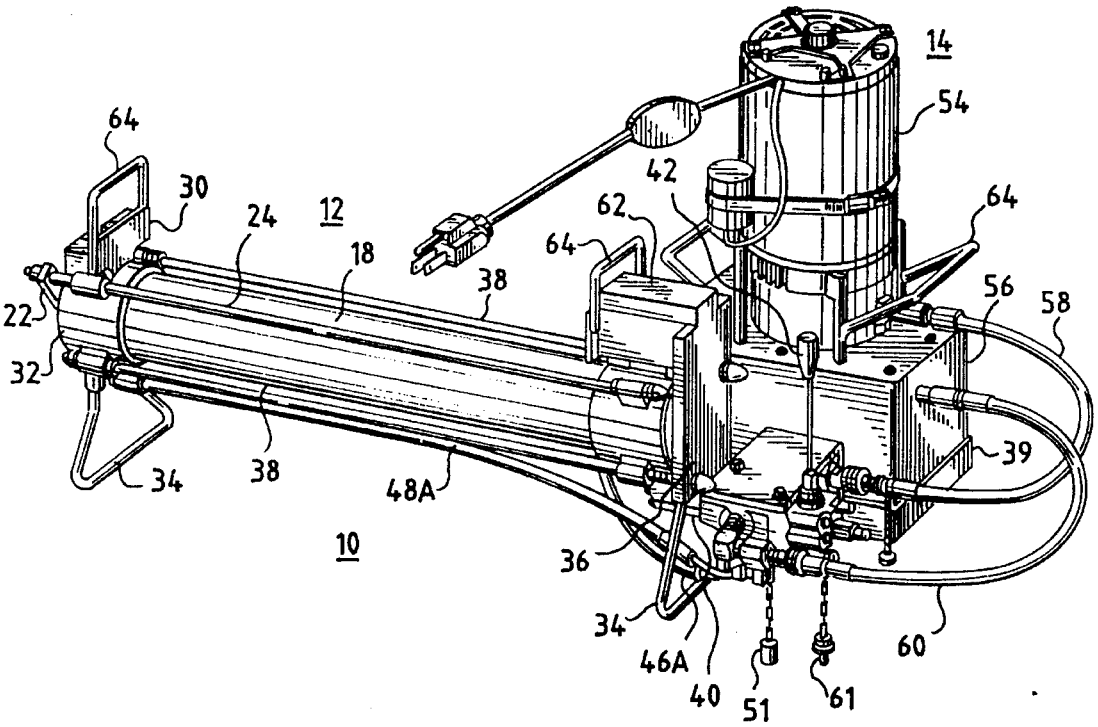
FIG. 1 shows a perspective view of the first preferred embodiment of the invention, comprising a portable hydraulic log splitter with a detachable electric power pack which contains a submerged hydraulic pump.

The first embodiment of the portable hydraulic log splitter assembly 10 comprising my invention is shown in FIG. 1. The assembly is comprised of two separable components, a splitter module 12, and a power pack module 14. The splitter module 12 includes a piston (not shown) that is driven within and along the length of cylinder 18. A piston rod 16 drives a cross bar 22 (see FIG. 5). The cross bar, in turn transmits the piston's longitudinal movement to rods 24 connected to each end of the cross bar 22. The rods 24, in turn, are connected to a collar 26 which forms the base for the cutting blade 28 that is initially housed (prior to a splitting stroke) within a stripper assembly 62. Stripper 62 removes any debris wedged on the blade 28 from a previous splitting stroke prior to commencing another splitting stroke. Thus, when the piston is driven along the cylinder 18, it pushes cross bar 22 forwardly, that in turn pulls rods 24 which in turn pull collar or base 26 and cutting blade 28 mounted therein into the log or wood being split. The collar or base 26 is constructed of an aluminum alloy to minimize the weight of the assembly.

In the preferred embodiment, the cutting blade 28 (FIGS. 6–8) is formed of an air hardening tool steel (AISI, Type A2) having an inclined disposition when mounted in collar 26 (FIG. 5) to maximize cutting or splitting effectiveness. More specifically, the cutting blade 28 also includes a plurality of through openings 29 that are placed along its side, as shown in FIG. 6, which fill with aluminum when the blade is molded into the collar 26. The cutting blade, in its preferred embodiment is 4.5 inches high by 1.25 inches wide by 0.25 inches thick. The openings 29 provide for an integral locking of the blade to collar 26.

A number of steps are required to manufacture the cutting blade. First, a block of annealed steel must be machined to provide a cutting edge. Second, the through holes 29 are drilled through the thickness of the cutting blade. Third, molten aluminum flows into the openings 29 when molding the blade into the collar 26. Finally, the cutting blade 28 and collar 26 subassembly is air dried. The heat from the aluminum serves to harden the steel of the cutting blade 28, thus increasing its working effectiveness. Also, the aluminum filling the openings 29 of the cutting blade 28 decreases the cutting blade weight, thus further increasing the portability of the log splitting module.

A log is held longitudinally in place by a front plate 30 that rests upon a front collar 32 that surrounds the cylinder 18. The front collar rests upon a support 34 to which it is welded. Likewise, the back end of cylinder 18, (i.e. that end away from the front plate 30) has a back plate 36 that rests upon a welded support 34. The collar 26, therefore, travels between the back plate 36 and front plate 30. The rotational stability of the cutting blade collar or base 26 about cylinder 18 is further argumented by guide rods 38 whose ends are secured to the back plate 36 and the front stationary collar 32. The rods 38 are diametrically disposed with respect to collar or base 26 and extend through base 26 in a sliding relationship. Further, the upper guide rod 38 and upper blade driving rod 24 combine to form a plane of support for a log as it is split. This plane of support between the cutting blade 28 (in the retracted position within stripper 62) and the front plate 30 is about eighteen inches in length in the preferred embodiment.

The preferred embodiment of the splitter module 12 also includes a reservoir receiver 39 for holding the power pack module 14 in place during the operation of the assembly 10. The reservoir receiver is preferably welded to the back plate 36 to minimize the length of the lines for the hydraulic fluids passing between the two modules.

Figure 4:
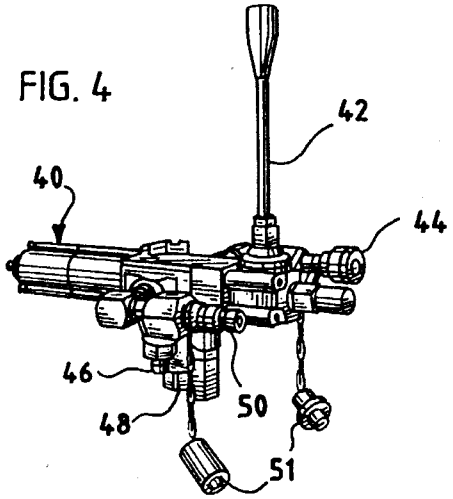
FIG. 4 shows the control valve for my invention.

The longitudinal movement of the piston within cylinder 18 is determined by a control valve 40 that is operated by a handle 42 (FIG. 4). The control valve used with the preferred embodiment is a four position, regenerative safety control valve that is designed and manufactured by Dinoil S.A.L. of Bandoli, Italy and is distributed through Bondioli & Pavesi, Inc. of Ashland, Va. The handle 42 is biased toward a neutral state (i.e., one that will disengage driving force, in the forward direction, being applied to the cutting blade 28) unless the handle 42 is manually moved by the operator forwardly to one of two driving speed positions or backwardly to a retraction driving position.

As shown in FIG. 4, control valve 40 has four ports: three high pressure ports and one low pressure port. There is a high pressure inlet port 44, a high pressure outlet port 46, and a high pressure return port 48. The one low pressure port is 50. High pressure inlet port 44 and the low pressure port 50 have stoppers 51 to prevent any leakage of hydraulic fluid when the splitter module 12 is disconnected from the power pack module 14 and to avoid contamination of the fluid in this mode. The low pressure port 50 in the valve transmits fluid from the valve 40 to the reservoir 56. The high pressure inlet port 44 receives fluid from the reservoir 56 and pump 52.

Figure 3:
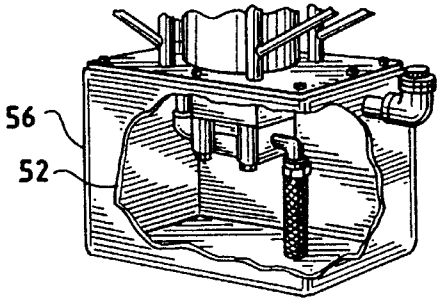
FIG. 3 shows a partially exposed view of the pump contained in the power pack module of the invention.

As shown in FIGS. 1 and 3, the first preferred embodiment of the invention includes a power pack module 14 comprising a pump 52 and an electric motor 54. The electric motor comprises a 1.5 HP motor that can be powered from a 110 volt outlet. The pump 52 is a single stage pump with dual rotation (i.e., it will operate in a clockwise or a counterclockwise rotation). The pump 52 is submerged in reservoir 56. The reservoir 56 contains the hydraulic fluid. When the power pack is mated or hydraulically connected with the splitter module 12, the reservoir rests within reservoir receiver 39. Alternatively, further stability in the horizontal plane for the power pack module to resist tipping can be achieved through the provision of flanges (not shown) jutting out from the sides of the reservoir and resting on an underlying flat surface. The pump 52 has reversible direction gears such that the single stage design can operate in either direction, thus accommodating operation with either a gas or an electric motor (which could have different rotational directions).

The power pack module 14 conveys fluid to and from the splitter module 12 respectively through a high pressure fluid hose 58 and a low pressure fluid hose 60. Both hoses also have stoppers 61 to prevent leakage and contamination of hydraulic fluid when the power pack and splitter assembly are broken down into modules. The high pressure fluid hose 58 is connected to the high pressure inlet port 44. The high pressure inlet port passes high pressure fluid from the pump to the control valve 40 in order to drive the piston in cylinder 18. The low pressure fluid hose 60 is designed to pass lower pressure fluid from the control valve 40 back to the reservoir 56 to be recirculated by the pump 52. Fluid hoses 46A and 48A hydraulically connect cylinder 18 to control valve 40 to reversibly drive the piston within cylinder 18 to and from as described more fully below.

In operation, the handle 42 has a first forward position and a second forward position. The first forward position directs fluid from the pump 52, through the high pressure fluid hose 58, through the high pressure inlet port 44, through the control valve 40, through the high pressure outlet port 46 and hose 46A, and into the cylinder 18 where it drives the piston forward, away from control valve 40. As a result, the cutting blade 28 is affirmatively carried forward into the log being split. The fluid which is pushed by the forward movement of the piston is carried out of the cylinder 18 through hose 48A and high pressure inlet port 48, through the control valve 40, out the low pressure outlet port 50, through the low pressure fluid hose 60 and into the reservoir 56. This first forward position of the valve handle can be used for logs that offer relatively high resistance to the cutting blade 28, such as those including knots or higher density wood. The control valve 40 has a relief feature which prevents the build-up of too much fluid pressure (i.e., more that 3000 psi) and possible mechanical failure.

A second, further forward position of the handle 42 utilizes the regenerative feature of the control valve 40. This position increases the forward moving speed of the cutting blade but reduces its driving force for faster, "light" splitting activity. This is brought about by utilizing "downside" fluid (i.e., that fluid being pushed out of cylinder 18 by the piston during a cutting stroke). The second forward position accomplishes this by routing at least some of the fluid returning to control valve 40 through the high pressure inlet port 48 back into the high pressure outlet port 46 where it combines with the high pressure fluid to drive the piston at greater speed. At least some of the return fluid passing through port 48 (at lower pressure than the fluid passing from port 44 to port 46) is drawn into port 46 by a venture effect which is presented when handle 42 is in the second, forwardmost position. This in turn facilitates withdrawal of fluid from cylinder 18 due to a corresponding reduction in pressure in hose 48A. Hence, a greater flow rate of fluid passing into the cylinder is provided, thus increasing the speed of the cutting blade 28, and decreasing the cutting stroke time. However, the portion of the fluid passing from the high pressure inlet port 48 is relatively low pressure, "downside" fluid (approximately 12–22 psi). Thus, the overall pressure of the fluid driving the piston is lower in the regenerative mode, thus decreasing the driving force of the cutting blade 28. This mode is desirable for use, for example, in finishing the splitting of a piece of wood after the initial resistance has been overcome.

When the cutting blade 28 has completed its full travel or when the fluid pressure within the valve 40 exceeds 3000 psi, the relief feature of the valve 40 will engage. Alternatively, the handle 42 can be put into a retraction position that reverses the fluid flow caused by the first and second forward handle positions, described above. In either event, fluid flows from the pump 52, through the high pressure hose 58, through the high pressure inlet port 44, through the control valve 40, through the high pressure port 48, and into the cylinder 18 where it drives the piston and the cutting blade ultimately back into the retracted position. If any wood remains stuck upon the cutting blade 28, the stripper 62 will remove the wood as the blade is retracted toward the back plate 36. The fluid being pushed by the retracting piston is directed back out of the cylinder 18, through the high pressure port 46, through the control valve 40, out the low pressure outlet port 50, through the low pressure fluid hose 60 and into the reservoir 56 for reuse.

The retraction mode of the control valve 40 does not require continuous manual engagement of the handle because of a detent feature within the control valve 40. The retraction valve 40 ultimately results in the build-up of fluid pressure within the valve 40 to about 600 psi, at which point detent will release and revert to its neutral position, ready for further use.

Each module is provided with handles 64 for easy lifting and transportation. The splitter module 12 has two handles 64 preferably welded to the stripper 62 and the front plate 30. The power pack module 14 has a handles 64 welded to the top of the reservoir 56. The two modules each weigh approximately seventy pounds, thus facilitating easy manual transportation and shipment by mail. The use of the diametrically disposed position driving rods 24 and guide rods 38 substantially reduces the weight of the splitter module while insuring its structural and operational integrity.

Figure 2:
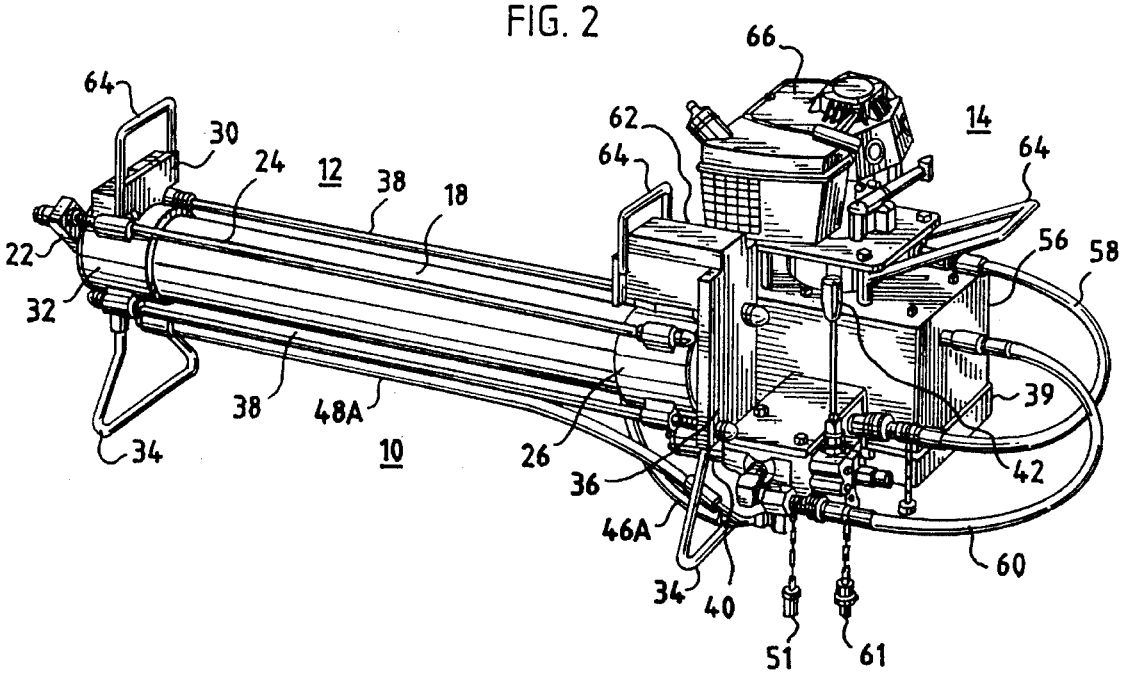
FIG. 2 shows a perspective view of the second preferred embodiment of the invention, Comprising a portable hydraulic log splitter with a detachable gasoline engine power pack which contains a submerged hydraulic pump.
Figure 5:
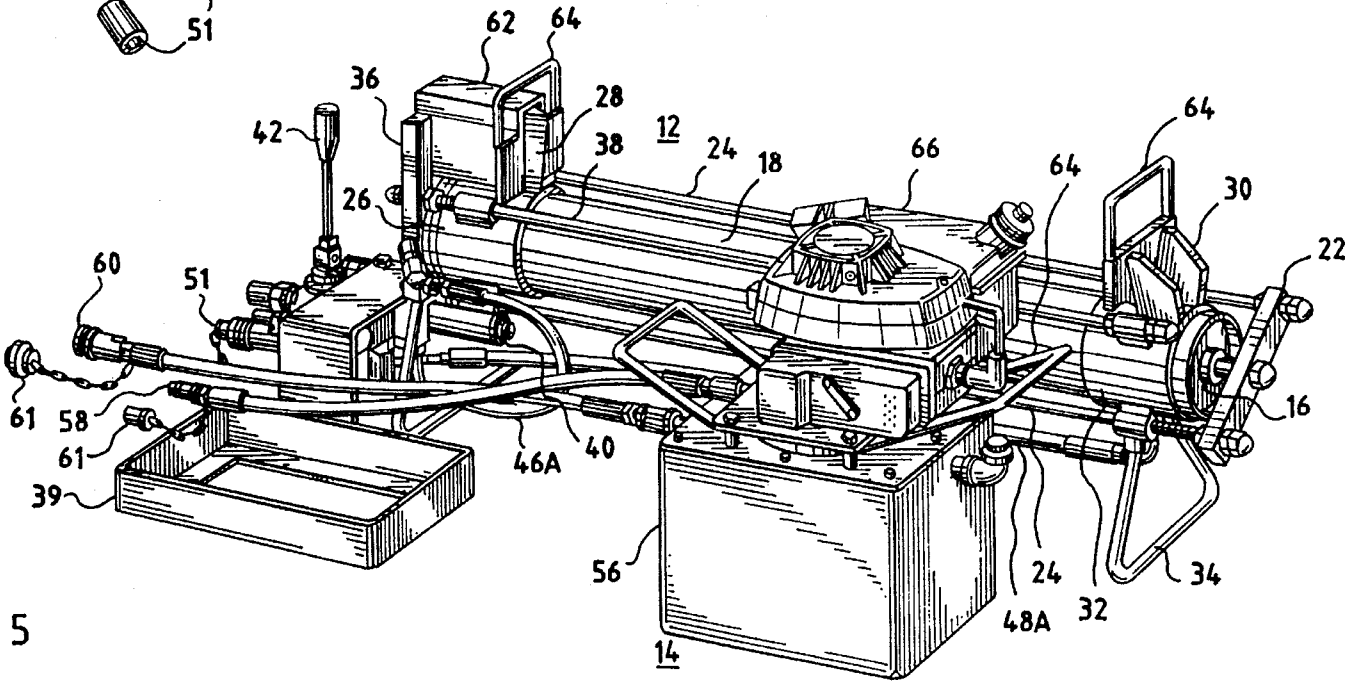
FIG. 5 shows a perspective view of my invention to further illustrate the details of the modular nature thereof.

The power pack module of the second preferred embodiment is shown in FIGS. 2 and 5. It has a similar pump 52 and reservoir 56, but utilizes a gas powered motor 66 having approximately the same power output as the electric motor 54.

From the foregoing, it will be appreciated that numerous variations and modifications may be implemented without departing from the true spirit and scope of the subject invention. No limitation with respect to the specifically described apparatus is intended or should be inferred. Rather, it is intended that all such modifications should be included within the scope of the claims.

I claim:

1. A portable hydraulic log splitter assembly for splitting logs, said assembly comprising:

a. a cutting blade;

b. mounting means for and operatively connected to said cutting blade for transporting said cutting blade toward and away from logs to be split;

c. a hydraulic cylinder and piston means, said piston means being operably connected to cutting blade mounting means said cutting blade mounting means further surmounting at least a portion of said hydraulic cylinder;

d. control valve means operably connected to said cylinder, said control valve means communicating hydraulic fluid to and from said cylinder to drive said piston;

e. a separable power pack means comprising at least:

(1) a motor;

(2) a hydraulic pump operatively connected to said motor, said pump communicating hydraulic fluid to said control valve means; and (3) a reservoir for holding hydraulic fluid and being in fluid communication with said hydraulic pump.

2. A portable hydraulic log splitter assembly for splitting logs, said assembly comprising:

a. a cutting blade;

b. mounting means for and attached to said cutting blade for transporting said cutting blade toward and away from logs to be split;

c. a plurality of driving rods attached to said mounting means for transporting said cutting blade mounting means toward and away from logs to be split, said rods providing a support plane for logs to be split;

d. a piston;

e. a cylinder to house said piston and support said cutting blade mounting means;

f. piston rod means connecting said driving rod means to said piston, thereby facilitating the reversible movement of said mounting means along the length of said cylinder;

g. a motor;

h. a hydraulic pump operatively connected to said motor, said pump communicating hydraulic fluid to said control valve; and i. a reservoir for holding hydraulic fluid, said reservoir operatively connected to said hydraulic pump.

3. The assembly of claim 1 further comprising drive rod means separatively connecting said cutting blade mounting means to said piston, thereby facilitating the reversible translation of said cutting mounting means along the length of said cylinder.

4. The assembly of claim 2 further comprising at least one guide rod coacting with said cutting blade mounting means for said cutting blade to preclude rotation of said cutting blade mounting means about said cylinder.

5. The assembly of claim 4, wherein at least one of said guide rods and at least one of said drive rod comprise a support plane for cradling logs.

6. The assembly of claim 1 further comprising at least one guide rod coacting with said cutting blade mounting means for said cutting blade to preclude rotation of said cutting blade mounting means about said cylinder.

7. A portable hydraulic log splitter assembly for splitting logs, said assembly comprising:

a. a cutting blade;

b. mounting means for and attached to said cutting blade for transporting said cutting blade toward and away from logs to be split;

c. a plurality of driving rods attached to said mounting means for driving said cutting blade mounting means toward and away from logs to be split;

d. at least one guide rod coacting with said cutting blade mounting means for said cutting blade to preclude rotation of said cutting blade mounting means about said cylinder, said guide rod further coacting with at least one of said drive rods to comprise a support plane for cradling logs to be split.

e. a piston;

f. a cylinder to house said piston and support said cutting blade mounting means;

g. piston rod means connecting said driving rod means to said piston, thereby facilitating the reversible movement of said mounting means along the length of said cylinder;

h. a motor;

i. a hydraulic pump operatively connected to said motor, said pump communicating hydraulic fluid to said control valve; and j. a reservoir for holding hydraulic fluid, said reservoir operatively connected to said hydraulic pump.

8. The assembly of claim 7, wherein each of said drive rods have a further drive rod diametrically disposed along the length of said hydraulic cylinder and each of said guide rods have further guide rod diametrically disposed along the length of said hydraulic cylinder.

9. A portable hydraulic log splitter assembly for splitting logs, said assembly comprising:

a. a cutting blade;

b. mounting means for and attached to said cutting blade for transporting said cutting blade toward and away from logs to be split;

c. a plurality of driving rods attached to said mounting means for driving said cutting blade mounting means toward and away from logs to be split;

d. at least one guide rod coacting with said cutting blade mounting means for said cutting blade to preclude rotation of said cutting blade mounting means about said cylinder, said guide rod coacting with at least one of said driving rods to form a plane of support for logs to be split;

e. a piston;

f. a cylinder to house said piston and support said cutting blade mounting means;

g. piston rod means connecting said driving rod means to said piston, thereby facilitating the reversible movement of said mounting means along the length of said cylinder;

h. a motor;

i. a hydraulic pump operatively connected to said motor, said pump communicating hydraulic fluid to said control valve; and j. a reservoir for holding hydraulic fluid, said reservoir operatively connected to said hydraulic pump.

10. A hydraulic log splitter assembly for splitting logs, said assembly comprising:

a. a cutting blade;

b. mounting means for and operatively connected to said cutting blade for transporting said cutting blade toward and away from logs to be split;

c. a hydraulic cylinder and piston means, said piston means being operably connected to cutting blade mounting means, said cutting blade mounting means further surmounting at least a portion of said hydraulic cylinder;

d. control valve means operably connected to said cylinder, said control valve means communicating hydraulic fluid to and from said cylinder to drive said piston;

e. a motor;

f. a hydraulic pump operatively connected to said motor, said pump communicating hydraulic fluid to said control valve means, said hydraulic pump further having reversible gears; and g. a reservoir for holding hydraulic fluid and being in fluid communication with said hydraulic pump.

11. The assembly of claim 9, wherein said hydraulic pump is adapted for operative connection with both gas and electric motors.

12. The assembly of claim 9, wherein at least said motor, said hydraulic pump, and said reservoir form a selectively attachable separate power pack module.

13. The assembly of claim 12, wherein said hydraulic pump is adapted for operative connection with both gas and electric motors.

14. A portable hydraulic log splitter assembly for splitting logs at variable speeds, said assembly comprising:

a. a cutting blade;

b. mounting means for and operatively connected to said cutting blade for transporting said cutting blade toward and away from logs to be split;

c. a hydraulic cylinder and piston means, said piston means being operably connected to cutting blade mounting means;

d. a control valve operatively connected to said cylinder, said control valve communicating hydraulic fluid to and from said cylinder to drive said piston, said control valve selectively reintroducing fluid displaced by said piston means into said cylinder to facilitate greater speed and less force in said cutting blade mounting means;

e. a motor;

f. a hydraulic pump operatively connected to said motor, said pump communicating hydraulic fluid to said control valve means; and g. a reservoir for holding hydraulic fluid and being in fluid communication with said hydraulic pump.

15. The assembly of claim 14, wherein said control valve includes a handle naturally biased against the communication of hydraulic fluid between said hydraulic pump and said hydraulic cylinder.

16. A log splitter assembly for splitting logs, said assembly comprising:

a. mounting means b. a cutting blade, said cutting blade defining at least one recess, said recess facilitating an integral molding to said mounting means, said mounting means thus transporting said cutting blade toward and away from logs to be split;

c. molding means for integrally attaching said cutting blade to said mounting means;

d. drive means operably connected to cutting blade mounting means; and e. control valve means operably connected to said drive means.

17. The assembly of claim 16, wherein said recess comprises a plurality of apertures extending through the thickness of said cutting blade.

18. The assembly of claim 17, wherein said cutting blade is comprised of steel, and said mounting means and said molding means are comprised of a substantially identical material having a lower density than steel.

19. A process for manufacturing and installing a cutting blade into the mounting means of a log splitter comprising the steps of:

a. machining the edge of a steel segment to provide a cutting edge;

b. drilling at least one aperture through the thickness of said steel segment;

c. pouring molten metal into said aperture and placing said blade in said mounting mounting means of a substantially similar metal; and d. air drying said cutting blade, thereby increasing its cutting effectiveness.

20. The process of claim 19, wherein the molten metal and the mounting means are each composed of lower density metals than steel.

21. A hydraulic log splitter assembly for splitting logs, said assembly comprising:

a. a cutting blade;

b. mounting means for and attached to said cutting blade for transporting said cutting blade toward and away from logs to be split;

c. at least one guide rod coacting with said cutting blade mounting means for said cutting blade to preclude rotation of said cutting blade mounting means about said cylinder d. a piston to drive said cutting blade mounting means;

e. a cylinder to house said piston and support said cutting blade mounting means;

f. a plurality of driving rods operatively attached to said mounting means and said piston, each of said plurality of said driving rods being symmetrically disposed about said cylinder, said driving rods moving said cutting blade mounting means toward and away from logs to be split;

g. a control valve connected to said cylinder, said control valve controllably communicating hydraulic fluid with said cylinder to drive said piston;

h. a separable power pack subassembly comprising at least:

(1) a motor;

(2) a hydraulic pump operatively connected to said motor, said pump having reversible gears, said pump communicating hydraulic fluid to said control valve; and (3) a reservoir for holding hydraulic fluid, said reservoir operatively communicating with said hydraulic pump.

22. The assembly of claim 21, wherein said control valve includes a second, selectable regenerative driving speed for low resistance cutting to be accomplished at a relatively higher speed.

23. The assembly of claim 21, wherein said cutting blade is integrally molded to said mounting means.

24. A portable hydraulic log splitter assembly for splitting logs, said assembly comprising:

a. a hydraulic cylinder and piston means;

b. a cutting blade and a stationary blade disposed over said hydraulic cylinder;

c. mounting means surmounting at least a portion of said hydraulic cylinder, with one of said blades being carried by said mounting means.

d. a plurality of driving rods operatively connected to said piston means and attached to said mounting means for transporting said mounting means toward and away from logs to be split, said rods providing a support plane for logs to be split;

e. control valve means operably connected to said cylinder, said control valve means communicating hydraulic fluid to and from said cylinder to drive said piston;

f. a separable power pack means comprising at least:

(1) a motor;

(2) a hydraulic pump operatively connected to said motor, said pump communicating hydraulic fluid to said control valve means; and (3) a reservoir for holding hydraulic fluid and being in fluid communication with said hydraulic pump.

* * * * *